US011078915B2

(12) United States Patent
Chen et al.

(10) Patent No.: US 11,078,915 B2
(45) Date of Patent: Aug. 3, 2021

(54) CONTRA-ROTATING FAN STRUCTURE

(71) Applicant: DELTA ELECTRONICS, INC., Taoyuan (TW)

(72) Inventors: Chien-Hung Chen, Taoyuan (TW); Chao-Fu Yang, Taoyuan (TW); Chien-Chih Huang, Taoyuan (TW); Yueh-Lung Huang, Taoyuan (TW); Shun-Chen Chang, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 0 days.

(21) Appl. No.: 16/596,750

(22) Filed: Oct. 8, 2019

(65) Prior Publication Data

US 2020/0378388 A1 Dec. 3, 2020

(30) Foreign Application Priority Data

May 31, 2019 (CN) ..... 201910466341.0

(51) Int. Cl.

| | |
|---|---|
| ***F04D 19/02*** | (2006.01) |
| ***F04D 29/32*** | (2006.01) |
| ***F04D 29/54*** | (2006.01) |
| ***F04D 19/00*** | (2006.01) |

(52) U.S. Cl.

CPC ..... *F04D 19/024* (2013.01); *F04D 19/007* (2013.01); *F04D 29/329* (2013.01); *F04D 29/542* (2013.01)

(58) Field of Classification Search

CPC ..... F04D 19/024

See application file for complete search history.

(56) References Cited

U.S. PATENT DOCUMENTS

| | | | | |
|---|---|---|---|---|
| 5,342,167 | A * | 8/1994 | Rosseau | F04D 29/666 415/119 |
| 7,909,568 | B2 * | 3/2011 | Ishihara | F04D 29/626 415/61 |
| 9,267,505 | B2 * | 2/2016 | Yanagisawa | F04D 19/024 |
| 10,344,764 | B2 * | 7/2019 | Nakamura | F04D 19/007 |
| 2014/0086761 | A1 * | 3/2014 | Abe | F04D 19/007 417/338 |

* cited by examiner

*Primary Examiner* — Michael Lebentritt
*Assistant Examiner* — Jason G Davis
(74) *Attorney, Agent, or Firm* — CKC & Partners Co., LLC

(57) ABSTRACT

A contra-rotating fan structure includes a first base, a first fan, a second base, and a second fan. The first fan is rotatably disposed on the first base and includes a first hub. The first hub has a first largest width. The second fan is rotatably disposed on the second base and includes a second hub. The second hub has a second largest width. The first base and the second base are located between the first fan and the second fan. The second largest width is greater than the first largest width.

9 Claims, 5 Drawing Sheets

CONTRA-ROTATING FAN STRUCTURE

CROSS-REFERENCE TO RELATED APPLICATION

This application claims priority to China Application Serial Number 201910466341.0, filed May 31, 2019, which is herein incorporated by reference in its entirety.

BACKGROUND

Technical Field

The present disclosure relates to a fan structure, and more particularly, to a contra-rotating fan structure.

Description of Related Art

With the rapid development of electronic products toward high performance, high frequency, high speed and light and thin, the heating temperature of electronic products is getting higher and higher, which is prone to instability and affect product reliability. Therefore, heat dissipation has become one of the important topics in the development of electronic products.

Nowadays, it is common to use fans as heat dissipation devices in electronic products. However, for an electronic product that generates a large amount of heat, a single fan is not enough to effectively dissipate heat. In addition, in order to avoid the interruption of the operation of the heat dissipation device caused by the failure of a single fan, a plurality of fans are generally used at the same time to increase the air volume of the airflow. Among them, the fans are axial fans.

However, when two fans are assembled in series but the structural configuration is not well designed, it is likely to cause the mutual influence and interference between the two fans. That is to say, the other fan in series not only does not have the effect of multiplying, but may cause a negative effect.

Accordingly, how to provide a contra-rotating fan structure to solve the aforementioned problems becomes an important issue to be solved by those in the industry.

SUMMARY

An aspect of the disclosure is to provide a contra-rotating fan structure which can effectively solve the aforementioned problems.

According to an embodiment of the disclosure, a contra-rotating fan structure includes a first base, a first fan, a second base, and a second fan. The first fan is rotatably disposed on the first base and includes a first hub. The first hub has a first largest width. The second fan is rotatably disposed on the second base and includes a second hub. The second hub has a second largest width. The first base and the second base are located between the first fan and the second fan. The second largest width is greater than the first largest width.

In an embodiment of the disclosure, the first base has a third largest width, the second base has a fourth largest width, and third and fourth largest widths are between the first and second largest widths.

In an embodiment of the disclosure, the third largest width is equal to the fourth largest width.

In an embodiment of the disclosure, the third largest width is greater than or equal to the first largest width. The fourth largest width is greater than or equal to the third largest width. The second largest width is greater than the fourth largest width.

In an embodiment of the disclosure, the third largest width is greater than the first largest width. The fourth largest width is greater than or equal to the third largest width. The second largest width is greater than or equal to the fourth largest width.

In an embodiment of the disclosure, the second fan is configured to rotate based on an axis. The second hub has an outer edge contour on a cross section passing through the axis. The outer edge contour has an inclined segment that is inclined relative to the axis.

In an embodiment of the disclosure, the outer edge contour further has a parallel segment that is connected to the inclined segment, parallel to the axis, and away from the second base than the inclined segment.

In an embodiment of the disclosure, the first fan is configured to rotate based on an axis. The first hub has an outer edge contour on a cross section passing through the axis. The outer edge contour has an inclined segment that is inclined relative to the axis.

In an embodiment of the disclosure, the outer edge contour further has a parallel segment that is connected to the inclined segment, parallel to the axis, and closer to the first base than the inclined segment.

In an embodiment of the disclosure, in a direction parallel to the axis, a ratio of a height of the parallel segment to a height of the outer edge contour is substantially between 0.2 and 0.85.

In an embodiment of the disclosure, the inclined segment is a straight line or a curved line.

In an embodiment of the disclosure, the contra-rotating fan structure further includes a plurality of first stationary blades and a plurality of second stationary blades. The first stationary blades are connected to an outer edge of the first base. The second stationary blades are connected to an outer edge of the second base. The first stationary blades are respectively connected to the second stationary blades to form a plurality of combined stationary blades.

In an embodiment of the disclosure, the first base has a center. Each of the first stationary blades has a root connected at the outer edge of the first base. The roots of the first stationary blades form a plurality of central angles to the center. At least two of the central angles are different.

Accordingly, in the contra-rotating fan structure of the present disclosure, the first fan and the second fan are operated in a counter-rotating manner (i.e., the rotation directions are opposite), so that air entering the contra-rotating fan structure is pressurized between the first fan and the second fan, thereby increasing the exit wind speed and effectively improving the heat dissipation capacity. Furthermore, by making the shape of the hub of the first fan asymmetric with respect to the shape of the hub of the second fan in the direction of the axis of rotation (e.g., making the largest width of the hub of the second fan greater than the largest width of the hub of the first fan), the characteristic performance of the contra-rotating fan structure of the present disclosure at medium and high impedance can be effectively improved. In addition, by making the shape of the hub of the second fan asymmetrical in the direction of the axis of rotation (e.g., making the outer edge contour of the hub of the second fan inclined), it is also helpful to improve the characteristic performance of the contra-rotating fan structure at the medium and high impedance.

It is to be understood that both the foregoing general description and the following detailed description are by examples, and are intended to provide further explanation of the disclosure as claimed.

BRIEF DESCRIPTION OF THE DRAWINGS

The disclosure can be more fully understood by reading the following detailed description of the embodiment, with reference made to the accompanying drawings as follows:

FIG. 2 is an exploded view of the contra-rotating fan structure shown in

FIG. 1;

DETAILED DESCRIPTION

Figure 1:
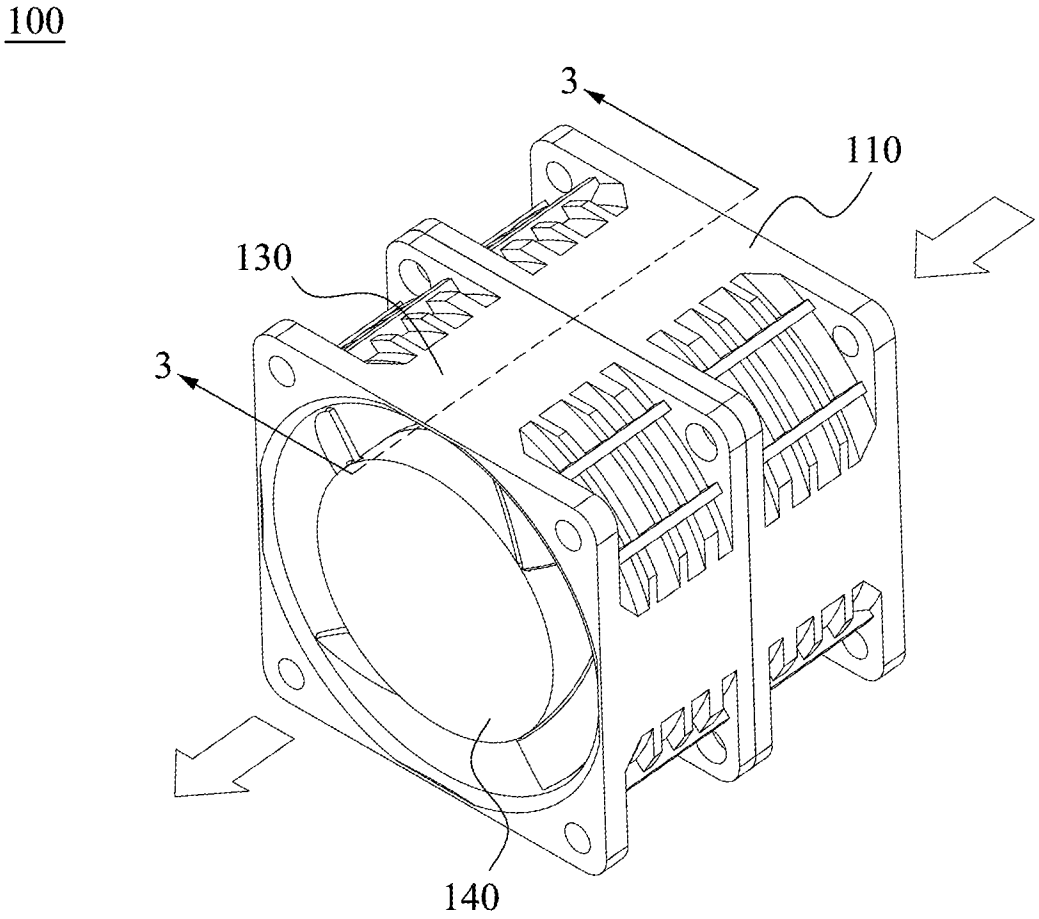
FIG. 1 is a perspective view of a contra-rotating fan structure according to an embodiment of the present disclosure.
Figure 2:
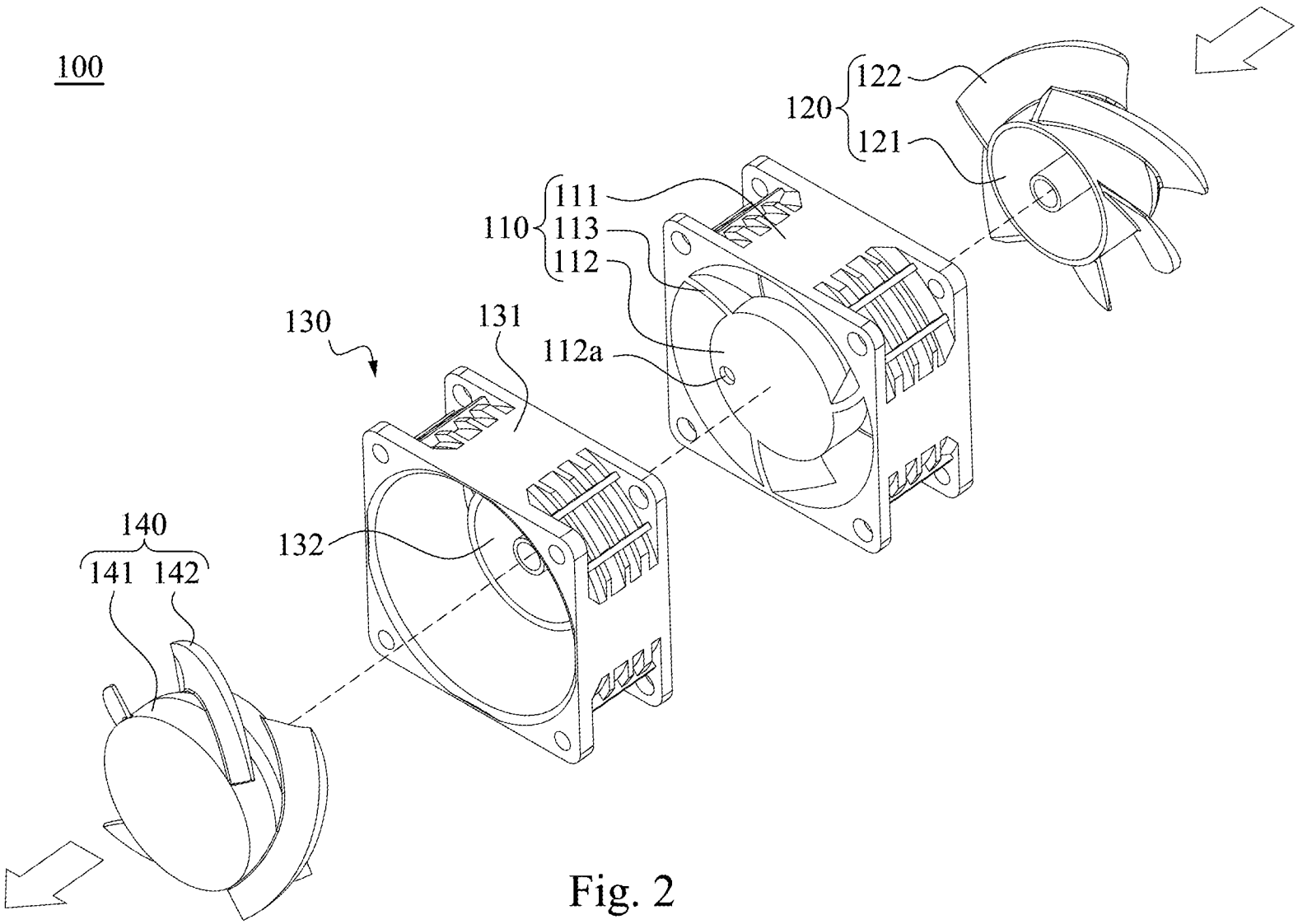
Figure 3:
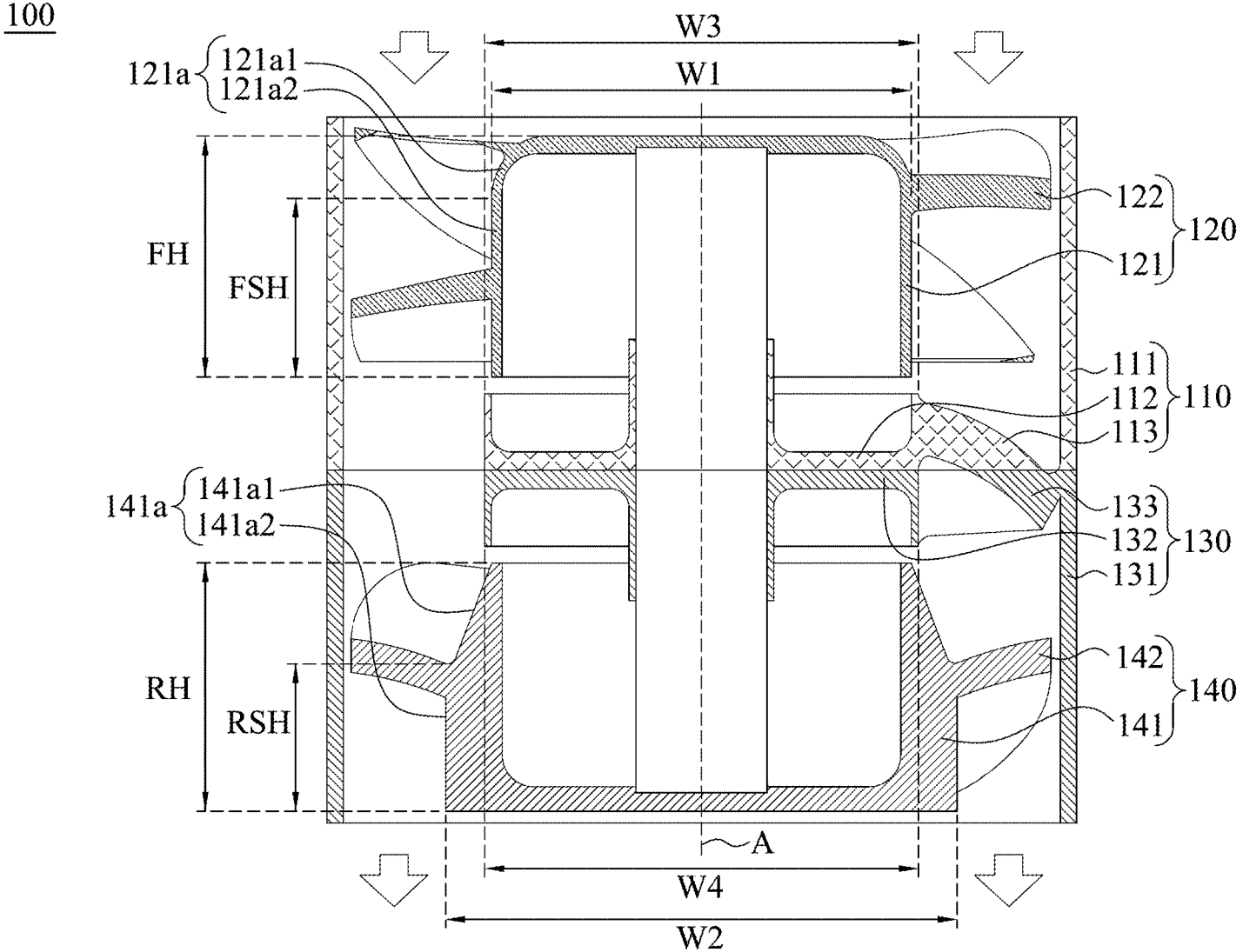
FIG. 3 is a cross-sectional view of the contra-rotating fan structure shown in FIG. 1 taken along line 3-3.

Reference is made to FIGS. 1 to 3. FIG. 1 is a perspective view of a contra-rotating fan structure 100 according to an embodiment of the present disclosure. FIG. 2 is an exploded view of the contra-rotating fan structure 100 shown in FIG. 1. FIG. 3 is a cross-sectional view of the contra-rotating fan structure 100 shown in FIG. 1 taken along line 3-3. As shown in FIGS. 1 and 2, in the present embodiment, the contra-rotating fan structure 100 includes a first housing 110, a first fan 120, a second housing 130, and a second fan 140. Structures and functions of components included in the contra-rotating fan structure 100 and connection and action relationships among these components are introduced in detail below.

As shown in FIG. 2, in the present embodiment, the first housing 110 includes a first outer wall 111, a first base 112, and a plurality of first stationary blades 113. The first outer wall 111 is hollow and has two opposite openings. The first base 112 is located at one of the openings of the first outer wall 111. The first stationary blades 113 are substantially radially connected between an inner edge of the first outer wall 111 and an outer edge of the first base 112. In the embodiment as shown in FIG. 2, a number of the first stationary blades 113 is three, but the disclosure is not limited in this regard and can be flexibly adjusted according to actual needs.

As shown in FIG. 2, in the present embodiment, the first fan 120 is accommodated in the first outer wall 111 (with reference to FIG. 3) and rotatably disposed on the first base 112. Specifically, the first fan 120 includes a first hub 121 and a plurality of first fan blades 122. The first hub 121 is rotatably connected to the first base 112 (e.g., through a pivotal shaft) based on an axis A (referring to FIG. 3). The first fan blades 122 are connected to an outer edge of the first hub 121 and configured to introduce air outside the first housing 110 into the first housing 110 when the first fan 120 rotates relative to the first housing 110, and direct the introduced air to the second housing 130 via the first stationary blades 113. In the embodiment as shown in FIG. 2, a number of the first fan blades 122 is five, but the disclosure is not limited in this regard and can be flexibly adjusted according to actual needs.

As shown in FIGS. 2 and 3, in the present embodiment, the second housing 130 includes a second outer wall 131, a second base 132, and a plurality of second stationary blades 133 (only one of which is shown in the cross section of FIG. 3). The second outer wall 131 is hollow and has two opposite openings. The second base 132 is located at one of the openings of the second outer wall 131 and abutted against the first base 112, such that the first base 112 and the second base 132 can also be regarded as a combined base. The second stationary blades 133 are substantially radially connected between an inner edge of the second outer wall 131 and an outer edge of the second base 132. In the present embodiment, a number of the second stationary blades 133 is the same as that of the first stationary blades 113 (i.e., the number is also three). In some embodiments, the first stationary blades 113 are respectively corresponded to the second stationary blades 133, such that the first stationary blades 113 are respectively connected to the second stationary blades 133 to form a plurality of combined stationary blades. In some embodiments, the first stationary blades 113 and the second stationary blades 133 can also be replaced by ribs.

In some embodiments, the first housing 110 and the second housing 130 can be a unitary structure manufactured by the same material (e.g., made of plastic using an injection molding process).

As shown in FIGS. 2 and 3, in the present embodiment, the second fan 140 is accommodated in the second outer wall 131 and rotatably disposed on the second base 132. Specifically, the second fan 140 includes a second hub 141 and a plurality of second fan blades 142. The second hub 141 is rotatably connected to the second base 132 based on the axis A (e.g., through a pivotal shaft). The first base 112 and the second base 132 are located between the first fan 120 and the second fan 140. The second fan blades 142 are connected to an outer edge of the second hub 141 and configured to introduce the introduced air (i.e., the air guided from the first stationary blades 113) into the second housing 130 via the second stationary blades 133 when the second fan 140 rotates relative to the second housing 130, and the introduced air exits the second housing 130 from the opening of the second outer wall 131 away from the second base 132. In the embodiment as shown in FIG. 2, a number of the second fan blades 142 is four, but the disclosure is not limited in this regard and can be flexibly adjusted according to actual needs.

It is noted that, in the present embodiment, the first fan 120 and the second fan 140 are operated in a counter-rotating manner (i.e., the rotation directions are opposite), so that the air entering the contra-rotating fan structure 100 is pressurized between the first fan 120 and the second fan 140, thereby increasing the exit wind speed and effectively improving the heat dissipation capacity.

As shown in FIG. 3, in the present embodiment, the first hub 121 has a first largest width W1, the second hub 141 has a second largest width W2, the first base 112 has a third largest width W3, and the second base 132 has a fourth largest width W4. The second largest width W2 is greater than the first largest width W1, and the third largest width W3 and the fourth largest width W4 are between the first largest width W1 and the second largest width W2. It can be seen that the shape of the first hub 121 of the first fan 120 is asymmetrically designed in a direction parallel to the axis A with respect to the shape of the second hub 141 of the second fan 140. With the structural configurations, the characteristic performance of the contra-rotating fan structure 100 of the present embodiment at medium and high impedance can be effectively improved. For specific reasons, please refer to the description of FIG. 4 below.

Figure 4:
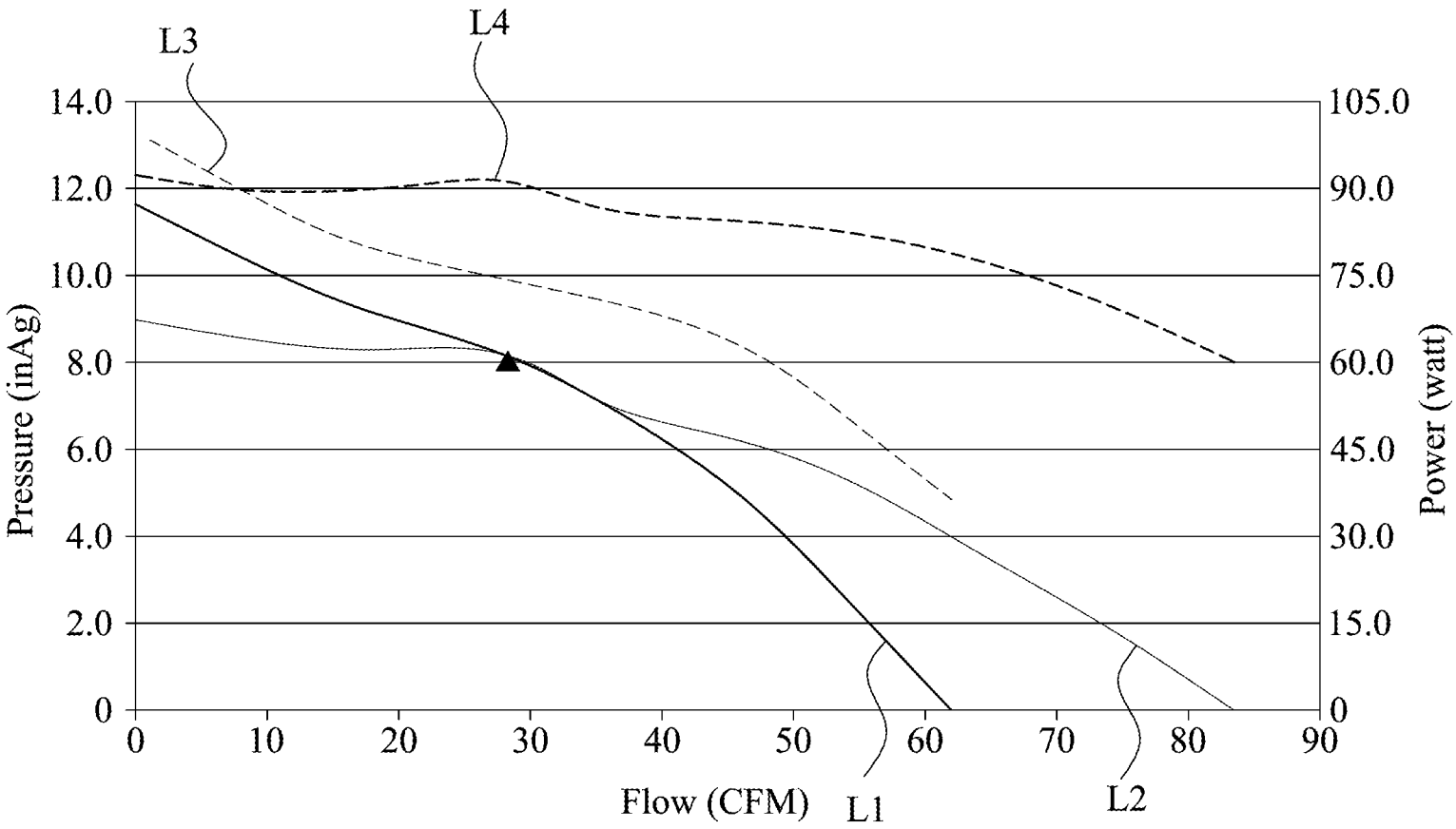
FIG. 4 is depicts characteristic curves of the contra-rotating fan structure under different design parameters according to an embodiment of the present disclosure.

Reference is made to FIG. 4. FIG. 4 is depicts characteristic curves of the contra-rotating fan structure 100 under different design parameters according to an embodiment of the present disclosure. As shown in FIG. 4, curves L1, L3 respectively represent a flow-pressure curve and a flow-power curve measured by the asymmetric design of the contra-rotating fan structure 100 (i.e., the second largest width W2 is greater than the first largest width W1) as shown in FIG. 1, in which rotational speeds of the first fan 120 and the second fan 140 are respectively 19,500 RPM (Revolutions Per Minute) and 18,500 RPM. Curves L2, L4 respectively represent a flow-pressure curve and a flow-power curve measured by the symmetrical design with the first largest width W1, the second largest width W2, the third largest width W3 and the fourth largest width W4 being the same, in which rotational speeds of the first fan 120 and the second fan 140 of the symmetric design are 24,300 RPM and 27,200 RPM, respectively. In applications where medium to high impedance (e.g., the flow is between about 20 CFM (Cubic Feet Per Minute) and about 40 CFM), the flow-pressure condition indicated by the triangle in FIG. 4 is used as an example. The symmetrical design of the contra-rotating fan structure 100 requires a higher rotational speed of fan (i.e., 24,300 RPM and 27,200 RPM) and a power of up to about 90 Watt to meet medium to high impedance applications. However, when the asymmetrically designed contra-rotating fan structure 100 shown in FIG. 1 is used, the rotational speeds of the first fan 120 and the second fan 140 need only be 19,500 RPM (which is lowered about 20%) and 18,500 RPM (which is about 32%) respectively, while the power only needs to be about 75 watts (which is saved about 17%), which can meet medium and high impedance applications. It can be seen that the contra-rotating fan structure 100 of the present embodiment has better characteristic performance at medium and high impedance.

As shown in FIG. 3, in the present embodiment, the third largest width W3 and the fourth largest width W4 are between the first largest width W1 and the second largest width W2, and the third largest width W3 is equal to the fourth largest width W4. In some embodiments, the third largest width W3 is greater than or equal to the first largest width W1, the fourth largest width W4 is greater than or equal to the third largest width W3, and the second largest width W2 is greater than the fourth largest width W4. In some embodiments, the third largest width W3 is greater than the first largest width W1, the fourth largest width W4 is greater than or equal to the third largest width W3, and the second largest width W2 is greater than or equal to the fourth largest width W4. In some embodiments, the first largest width W1, the third largest width W3, the fourth largest width W4, and the second largest width W2 are incremented sequentially.

In the cross section of FIG. 3, the second hub 141 has an outer edge contour 141*a*. The outer edge contour 141*a* has an inclined segment 141*a*1 and a parallel segment 141*a*2. The inclined segment 141*a*1 is inclined relative to the axis A. The parallel segment 141*a*2 is connected to the inclined segment 141*a*1, parallel to the axis A, and away from the second base 132 than the inclined segment 141*a*1. A portion of the second fan blade 142 connected to the outer edge of the second hub 141 includes the inclined segment 141*a*1 and the parallel segment 141*a*2. It can be seen that the shape of the second hub 141 of the second fan 140 is asymmetrically designed in a direction parallel to the axis A. With the structural configurations, it is also helpful to improve the characteristic performance of the contra-rotating fan structure 100 of the present embodiment at medium and high impedance.

In some embodiments, as shown in FIG. 3, in a direction parallel to the axis A, a ratio of a height RSH of the parallel segment 141*a*2 to a height RH of the outer edge contour 141*a* is substantially between 0.2 and 0.85. If the ratio is greater than 0.85, it is easy to cause the airflow to directly hit the second hub 141, thereby reducing the flow. If the ratio is smaller than 0.2, the outer edge contour 141*a* is similar to the design in which the entire segment is a inclined segment, which may make the airflow pressing effect not obvious or have a negative effect.

As shown in FIG. 3, the first hub 121 has an outer edge contour 121*a*. The outer edge contour 121*a* has an inclined segment 121*a*1 and a parallel segment 121*a*2. The inclined segment 121*a*1 is inclined relative to the axis A. The parallel segment 121*a*2 is connected to the inclined segment 121*a*1, parallel to the axis A, and closer to the first base 112 than the inclined segment 121*a*1. A portion of the first fan blade 122 connected to the outer edge of the first hub 121 includes the inclined segment 121*a*1 and the parallel segment 121*a*2. It can be seen that the shape of the first hub 121 of the first fan 120 is asymmetrically designed in a direction parallel to the axis A.

As shown in FIG. 3, in the present embodiment, the inclined segment 141*a*1 is a straight line, the inclined segment 121*a*1 is a curved line, but the disclosure is not limited in this regard. In practical applications, the inclined segment 141*a*1 can be changed to a curved line, and the inclined segment 121*a*1 can be changed to a straight line.

In some embodiments, as shown in FIG. 3, in a direction parallel to the axis A, a ratio of a height FSH of the parallel segment 121*a*2 to a height FH of the outer edge contour 121*a* is substantially between 0.2 and 0.85. If the ratio is greater than 0.85, the outer edge contour 121*a* is similar to the design in which the entire segment is a parallel segment, resulting in a reduction in the air inlet area and a decrease in the effectiveness of the first hub 121 in guiding airflow. If the ratio is smaller than 0.2, the outer edge contour 121*a* is similar to the design in which the entire segment is an inclined segment, resulting in the first hub 121 cannot be installed with its internal iron shell.

Figure 5:
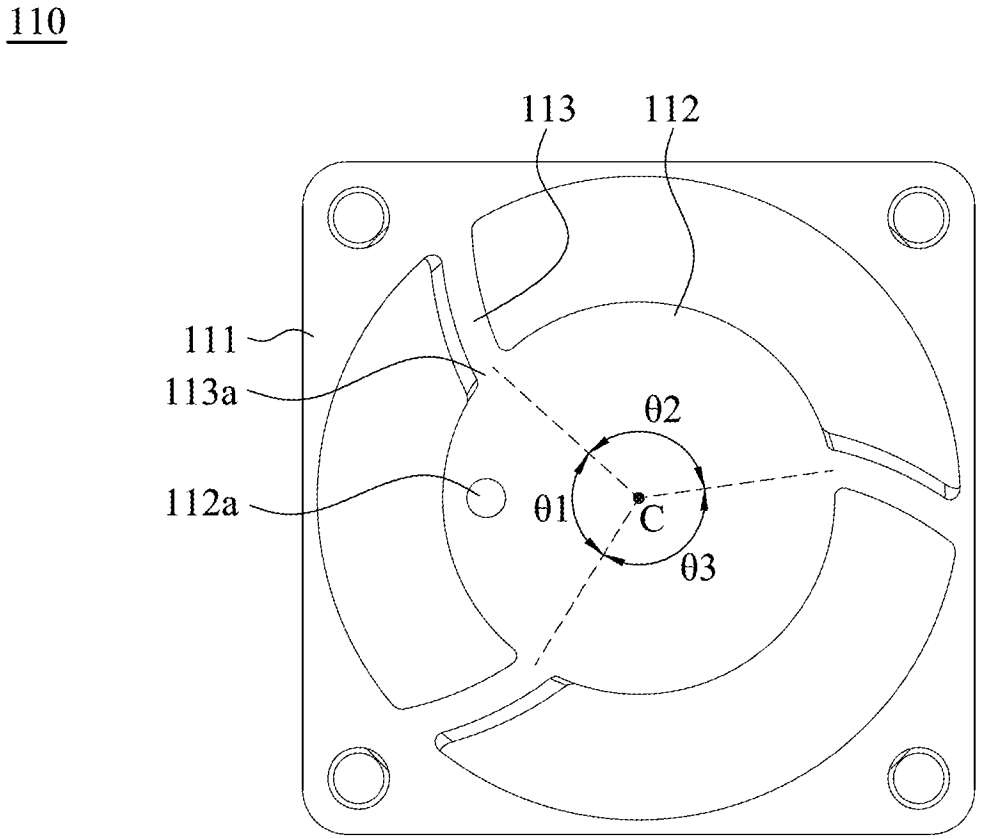
FIG. 5 is a bottom view of a first housing shown in FIG. 1.

Reference is made to FIG. 5. FIG. 5 is a bottom view of the first housing 110 shown in FIG. 1. As shown in FIGS. 2 and 5, the first base 112 has a center C and a through hole 112*a*. The through hole 112*a* is available for routing of internal wiring of the contra-rotating fan structure 100. The first stationary blades 113 have roots 113*a* connected at the outer edge of the first base 112. The roots 113*a* (e.g., centers of the roots 113*a*) form a plurality of central angles θ1, θ2, θ3 to the center C, and at least two of the central angles θ1, θ2, θ3 are different. For example, the through hole 112*a* is formed on a portion of the first base 112 corresponding to the central angle θ1, so the structural strength of the portion of the first base 112 may be affected. By designing the central angle θ1 (e.g., about 100 degrees) to be smaller than the central angles θ2, θ3, the central angle θ1 corresponding to the through hole 112*a* has a minimum angle, thereby effectively increase the structural strength of the portion of the first base 112 corresponding to the central angle θ1.

According to the foregoing recitations of the embodiments of the disclosure, it can be seen that in the contra-rotating fan structure of the present disclosure, the first fan and the second fan are operated in a counter-rotating manner (i.e., the rotation directions are opposite), so that air entering the contra-rotating fan structure is pressurized between the first fan and the second fan, thereby increasing the exit wind speed and effectively improving the heat dissipation capacity. Furthermore, by making the shape of the hub of the first fan asymmetric with respect to the shape of the hub of the second fan in the direction of the axis of rotation (e.g., making the largest width of the hub of the second fan greater than the largest width of the hub of the first fan), the characteristic performance of the contra-rotating fan structure of the present disclosure at medium and high impedance can be effectively improved. In addition, by making the shape of the hub of the second fan asymmetrical in the direction of the axis of rotation (e.g., making the outer edge contour of the hub of the second fan inclined), it is also helpful to improve the characteristic performance of the contra-rotating fan structure at the medium and high impedance.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A contra-rotating fan structure, comprising:

a first base;

a first fan rotatably disposed on the first base and comprising a first hub, the first hub having a first largest width;

a second base; and a second fan rotatably disposed on the second base and comprising a second hub, the second hub having a second largest width, wherein the second fan is configured to rotate based on an axis, the second hub has an outer edge contour on a cross section passing through the axis, the outer edge contour has an inclined segment and a parallel segment, the inclined segment is inclined relative to the axis, and the parallel segment is connected to the inclined segment, parallel to the axis, and away from the second base than the inclined segment, wherein the first base and the second base are located between the first fan and the second fan, the first base has a third largest width, the second base has a fourth largest width, the second largest width is greater than the first largest width, and the third and fourth largest widths are between the first and second largest widths, wherein in a direction parallel to the axis, a ratio of a height of the parallel segment to a height of the outer edge contour is substantially between 0.2 and 0.85.

2. The contra-rotating fan structure of claim 1, wherein the third largest width is equal to the fourth largest width.

3. The contra-rotating fan structure of claim 1, wherein the third largest width is greater than the first largest width, the fourth largest width is greater than or equal to the third largest width, and the second largest width is greater than the fourth largest width.

4. The contra-rotating fan structure of claim 1, wherein the third largest width is greater than the first largest width, the fourth largest width is greater than or equal to the third largest width, and the second largest width is greater than or equal to the fourth largest width.

5. The contra-rotating fan structure of claim 1, wherein the inclined segment is a straight line or a curved line.

6. The contra-rotating fan structure of claim 1, further comprising a plurality of first stationary blades and a plurality of second stationary blades, the first stationary blades are connected to an outer edge of the first base, the second stationary blades are connected to an outer edge of the second base, and the first stationary blades are respectively connected to the second stationary blades to form a plurality of combined stationary blades.

7. The contra-rotating fan structure of claim 6, wherein the first base has a center, each of the first stationary blades has a root connected at the outer edge of the first base, the roots of the first stationary blades form a plurality of central angles to the center, and at least two of the central angles are different.

8. A contra-rotating fan structure, comprising:

a first base;

a first fan rotatably disposed on the first base and comprising a first hub, the first hub having a first largest width, wherein the first fan is configured to rotate based on an axis, the first hub has an outer edge contour on a cross section passing through the axis, the outer edge contour has an inclined segment and a parallel segment, the inclined segment is inclined relative to the axis, and the parallel segment is connected to the inclined segment, parallel to the axis, and closer to the first base than the inclined segment;

a second base; and a second fan rotatably disposed on the second base and comprising a second hub, the second hub having a second largest width, wherein the first base and the second base are located between the first fan and the second fan, the first base has a third largest width, the second base has a fourth largest width, the second largest width is greater than the first largest width, and the third and fourth largest widths are between the first and second largest widths, wherein in a direction parallel to the axis, a ratio of a height of the parallel segment to a height of the outer edge contour is substantially between 0.2 and 0.85.

9. The contra-rotating fan structure of claim 8, wherein the inclined segment is a straight line or a curved line.

* * * * *